US005413511A

United States Patent [19]

Hawkenson

[11] Patent Number: 5,413,511

[45] Date of Patent: May 9, 1995

[54] OUTBOARD MOTOR DRIVE SYSTEM

[76] Inventor: Bruce R. Hawkenson, 1667 Rebman Crescent, Prince George, British Columbia, Canada, V2L 4Z9

[21] Appl. No.: 261,056

[22] Filed: Jun. 13, 1994

[51] Int. Cl.[6] ..... B63H 1/14

[52] U.S. Cl. ..... 440/49

[58] Field of Search ..... 30/381, 383, 122; 83/788, 793, 820; 440/113, 900, 53, 49, 58, 3, 4, 30

[56] References Cited

U.S. PATENT DOCUMENTS

| | | | |
|---|---|---|---|
| 4,534,737 | 8/1985 | Henderson | 440/53 |
| 4,604,067 | 8/1986 | Roberts | 440/900 |
| 4,615,117 | 10/1986 | Flath | 30/122 |
| 4,964,823 | 10/1990 | Newman et al. | 440/53 |

*Primary Examiner*—Edwin L. Swinehart
*Attorney, Agent, or Firm*—Elbie R. De Kock

[57] ABSTRACT

An outboard motor adaptor (10) comprises an upper housing (12) provided with a connection bar (24) having formations (28, 30) thereon for engaging with bar studs (44) on a chainsaw housing (42). A stem (14) extends from the upper housing (12) and a lower skeg and propeller portion (16) is provided on the opposite end of the stem (14). The skeg and propeller portion (16) is provided with a propeller (32) thereon. A drive sprocket (22) is provided on the upper housing (12) adjacent the bar (24). The drive sprocket (22) is operatively connected to the propeller (32) for driving the propeller (32). A drive chain (26) extends around the drive sprocket (22) and the connection bar (24). A space (48) is provided between the bar (24) and the drive chain (26) at the location opposite the drive sprocket (22) for receiving a chainsaw sprocket (46) of a chainsaw motor in the space (48) to engage with the drive chain (26), thereby to drive the drive sprocket (22) and the propeller (32) through the drive chain (26).

2 Claims, 1 Drawing Sheet

OUTBOARD MOTOR DRIVE SYSTEM

FIELD OF THE INVENTION

This invention relates to an outboard motor drive system.

BACKGROUND OF THE INVENTION

Although there are several makes and models of chain saws available on the market, they all have certain basic features in common. The first of these are the bar studs which locate the chain bar in position and which studs are almost identical on all chain saw engines. The second is the chain saw sprocket through which the driving power of the chain saw is connected to the chain saw chain.

It would be advantageous if a chain saw, which is a commonly available piece of equipment, particularly in wooded areas, could be employed in other applications without needing to make any modifications to the basic chain saw motor. It is accordingly an object of the present invention to provide an arrangement whereby a chain saw motor can be used in an outboard motor system on a boat.

SUMMARY OF THE INVENTION

According to the invention, there is provided an outboard motor adaptor, comprising an upper housing provided with a connection bar having formations thereon for engaging with bar studs on a chain saw housing; a stem extending from said housing; a lower skeg and propeller portion on the opposite end of said stem provided with a propeller thereon; a drive sprocket on said upper housing adjacent said bar, said drive sprocket being operatively connected to the propeller on said lower portion for driving said propeller; and a drive chain extending around said drive sprocket and said connection bar, wherein a space is provided between said bar and said drive chain at a location opposite said drive sprocket for receiving a chain saw sprocket of a chain saw motor in said space to engage with said drive chain, thereby to drive said drive sprocket and said propeller through said drive chain.

The invention also extends to an outboard motor system comprising the combination of a chain saw motor and an outboard motor adaptor as described above.

Further objects and advantages of the invention will become apparent from the description of a preferred embodiment of the invention below.

DETAILED DESCRIPTION OF PREFERRED EMBODIMENT

Figures 1, 2:
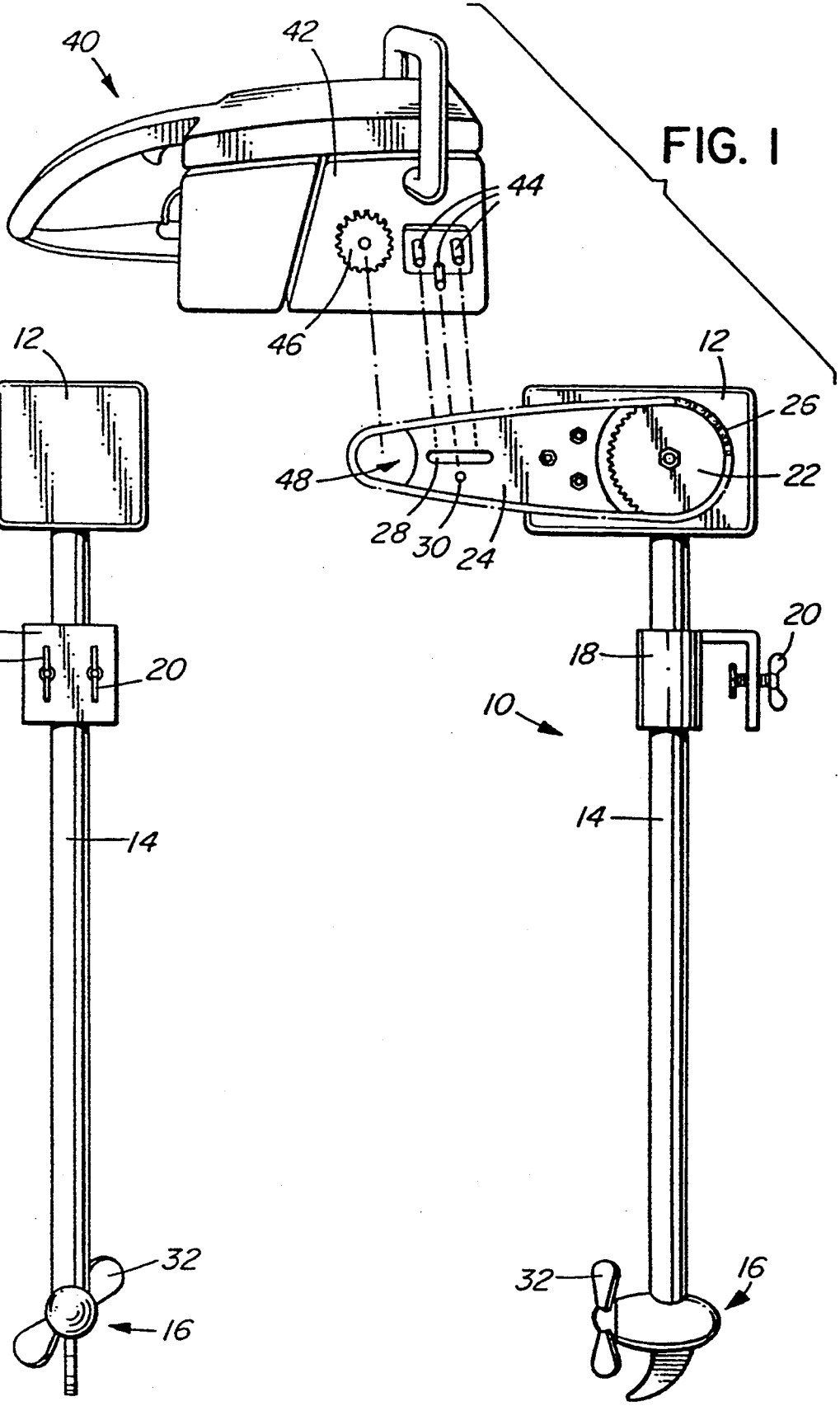
FIG. 1 is a side view of an outboard motor adaptor for a chain saw motor and also showing a standard chain saw motor for connection thereto.
FIG. 2 is a side view of the outboard motor adaptor of FIG. 1.

In the drawings reference numeral 10 generally indicates an outboard motor adaptor comprising an upper housing 12, a stem 14 extending from the housing and a lower skeg and propeller portion 16. A bracket 18 provided with wing nuts 20 is provided on the stem 14 for attaching the adaptor 10 to the rear end of a boat.

A sprocket 22 and a chain bar 24 are provided on the upper housing 12. The bar 24 has a groove for receiving a cutterless chain 26 extending around the bar 24 and the sprocket 22. The chain 26 is similar to a standard chain saw chain but it is without the conventional cutting elements thereon.

The bar 24 is provided with a slot 28 and hole 30 to fit onto the bar studs of different conventional chain saw motors.

A propeller 32 is provided on the lower portion 16 and it is located on a shaft which is connected through bevel gears to a rotary shaft inside the stem 14 which extends up into the upper housing 12. The upper end of the rotary shaft is connected to the sprocket 22 through a set of gears inside the housing 12 for converting the rotary motion of the sprocket 22 into rotation of the rotary shaft to drive the propeller 32.

As shown in FIG. 1, a typical chain saw 40 comprises a housing 42, which contains the chain saw motor, and which housing 42 is provided with a set of bar studs 44 and a chain saw sprocket 46 for connecting the chain saw motor to the chain saw chain.

In order to attach the chain saw 40 to the outboard motor adaptor 10, the conventional chain saw and bar are removed from the chain saw 40 and the housing 42 is then mounted on the bar 24 by inserting the bar studs 44 through the slot 28 and hole 30. The chain saw sprocket 46 is engaged with the chain 26 by inserting it at one end of the bar 24. For this purpose, the bar 24 is provided with a cutout 48 to receive the sprocket 46.

With the chain saw motor connected to the adaptor in this fashion, the combination of the chain saw motor and the adaptor can be used as an outboard motor in the conventional fashion.

It can be seen, therefore, that the present invention provides a motor boat drive system in which a regular chain saw motor is utilized without any modification to the chain saw motor being required, except for the removal of the saw bar and cutter chain.

While only a preferred embodiment of the invention have been described herein in detail, the invention is not limited thereby and modifications can be made within the scope of the attached claims.

What is claimed is:

1. An outboard motor adaptor, comprising:

an upper housing provided with a connection bar having formations thereon for engaging with bar studs on a chain saw housing;

a stem extending from said housing;

a lower skeg and propeller portion on the opposite end of said stem provided with a propeller thereon;

a drive sprocket on said upper housing adjacent said bar, said drive sprocket being operatively connected to the propeller on said lower portion for driving said propeller; and a drive chain extending around said drive sprocket and said connection bar, wherein a space is provided between said bar and said drive chain at a location opposite said drive sprocket for receiving a chain saw sprocket of a chain saw motor in said space to engage with said drive chain, thereby to drive said drive sprocket and said propeller through said drive chain.

2. The combination of a chain saw motor and an outboard motor adaptor as claimed in claim 1.

* * * * *